US005628066A

United States Patent [19]

Gottlieb et al.

[11] Patent Number: 5,628,066

[45] Date of Patent: May 13, 1997

[54] METHOD OF RESCUING A PERSON FROM A FIRE EMERGENCY

[76] Inventors: Baruch Gottlieb, 80 Pdtah Tikva Road, Tel Aviv, Israel, 67138; Jack Trilling, 15A Basswood Plz., Cranbury, N.J. 08512; Meir Brenner, 80 Pdtah Tikva Road, Tel Aviv, Israel, 67138

[21] Appl. No.: 511,120

[22] Filed: Aug. 4, 1995

Related U.S. Application Data

[63] Continuation of Ser. No. 23,469, Feb. 25, 1993, abandoned, which is a continuation of Ser. No. 915,034, Jul. 16, 1992, abandoned, which is a continuation of Ser. No. 543,011, Jun. 25, 1990, abandoned.

[51] Int. Cl.[6] ..... A41D 13/00

[52] U.S. Cl. ..... 2/84; 2/81; 2/85; 2/88; 169/48; 206/213; 206/278

[58] Field of Search ..... 2/69, 69.5, 70, 2/81, 84, 85, 88, 93; 169/45, 48, 50, 51; 206/205, 213, 278, 278.1, 803; 604/289, 291

[56] References Cited

U.S. PATENT DOCUMENTS

| | | | |
|---|---|---|---|
| 2,109,951 | 3/1938 | Truesdell | 2/84 |
| 2,676,319 | 4/1954 | Davidson | 2/84 |
| 3,902,559 | 9/1975 | Everingham | 128/155 |
| 4,078,264 | 3/1978 | DeGennaro | 2/88 |
| 4,951,815 | 8/1990 | Ulbrich | 206/278 |

FOREIGN PATENT DOCUMENTS

| | | | |
|---|---|---|---|
| 862676 | 3/1941 | France | 2/88 |
| 1057246 | 3/1954 | France | 2/84 |

*Primary Examiner*—Diana Biefeld
*Attorney, Agent, or Firm*—Kenyon & Kenyon

[57] ABSTRACT

A fire protection garment may be constructed of a one piece woven fabric integrally formed to create a cloak-like garment to create a fire retardant emergency device. The garment contains a hood portion, a body portion formed with an entrance opening and a manipulating device on the interior of the body portion on each side of the entrance opening. The manipulating device can be hand receiving pockets. The garment is formed of a fabric selected to retain a fire retarding fluid so that the garment protects a person or persons within the garment from high intensity heat or flames. The manipulating device or hand receiving pockets provide a means for controlling the opening of the garment to enable a rescue to occur.

7 Claims, 3 Drawing Sheets

METHOD OF RESCUING A PERSON FROM A FIRE EMERGENCY

This application is a continuation of Ser. No. 08/023,469, filed Feb. 25, 1993, now abandoned, which is a continuation of Ser. No. 07/915,034 filed Jul. 16, 1992, now abandoned which is a continuation of Ser. No. 07/543,011 filed Jun. 25, 1990, now abandoned.

BACKGROUND OF THE INVENTION

This invention relates to a fire protection garment and, in particular to, a robe like garment soaked in a viscous aqueous solution with a thickening agent to protect a person who is subject to heat and flames.

Numerous fire fighting products and devices are available. Of these, many of the fire fighting mechanical products and devices (as opposed to liquids and gases) make use of asbestos cloth. It is known, today, that asbestos is an extremely carcinogenic material and its use has fallen into disfavor throughout the world. Furthermore, in a fire or burn emergency, multiple person rescues are often limited by the exhaustion of the rescuer and the size of the rescuing device. Exemplary of another form of prior art device is disclosed in U.S. Pat. No. 3,902,559, issued to Everingham et al, which discloses a fire fighting appliance. This fire fighting appliance includes a blanket-like carrier soaked in a viscous aqueous solution of a thickening agent. The fire fighting appliance disclosed, while a great improvement over other devices, has proved difficult under certain circumstances to wrap around a person, potentially leaving portions of the user's body exposed to the heat and flames, and difficult under certain circumstances to use with two people.

It is, therefore, desirable to provide an improved fire protection device which is easier to use and enables one or more people to be protected against intense heat and flames while escaping from or effecting a rescuing of another person during a fire emergency.

SUMMARY OF THE INVENTION

Generally speaking, in accordance with the present invention a fire protection garment is provided. The fire protection garment acts as a fire retardant during a fire emergency. The garment is comprised of a cloak-like garment including a hood portion, a body portion formed with an entrance opening and internal manual manipulatable means on opposed sides of the entrance opening. The garment, preferably soaked in a viscous aqueous solution or at least water or another fire retarding fluid, is designed to enable a person or persons to be protected against intense heat and flames. The manipulating means, preferably in the form of hand receiving pockets, enable the user to manipulate the entrance opening to the garment, as well as heated objects and to facilitate use with another person and escape from the fire danger.

Accordingly it is an object of the present invention to provide an improved fire protection garment.

Another object of the invention is to provide a simple to use device that protects a person against intense heat and flames.

A further object of the invention is to provide a fire protection garment which is easily applied and which is readily manipulated when worn.

Yet a further object of the invention is to provide a fire protection garment which gives the rescuer more maneuverability or flexibility during an emergency.

Still another object of the present invention is to provide a fire protection garment which can protect more than one person.

Still other objects and advantages of the invention will in part be obvious and will in part be apparent from the specification.

The invention accordingly comprises a product possessing features, properties and the relation of components in the several steps in the relation of one or more of such steps with respect to each of the others thereof, which will be exemplified in the product and method hereinafter described and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 2:
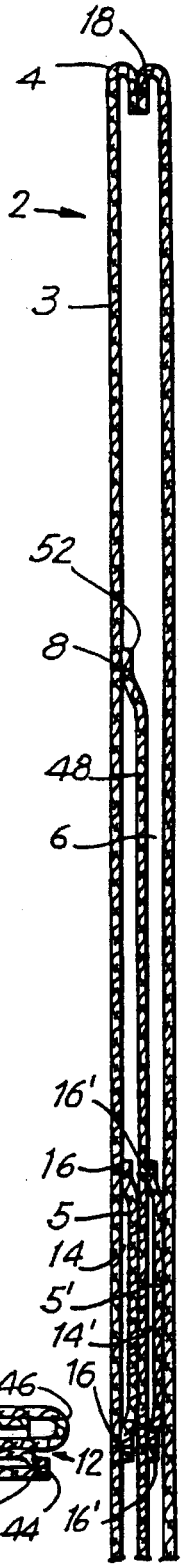
FIG. 2 is an enlarged fragmentary cross-sectional view of the fire protection garment of FIG. 1 taken along lines 2—2 of FIG. 1.
Figure 3:
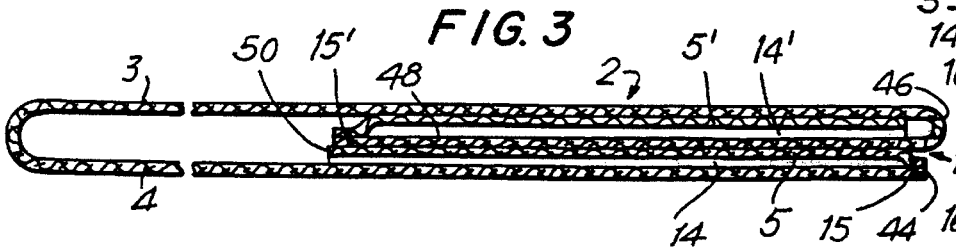
FIG. 3 is an enlarged cross-sectional view of the fire protection garment of FIG. 1 taken along lines 3—3 of FIG. 1.
Figure 4:
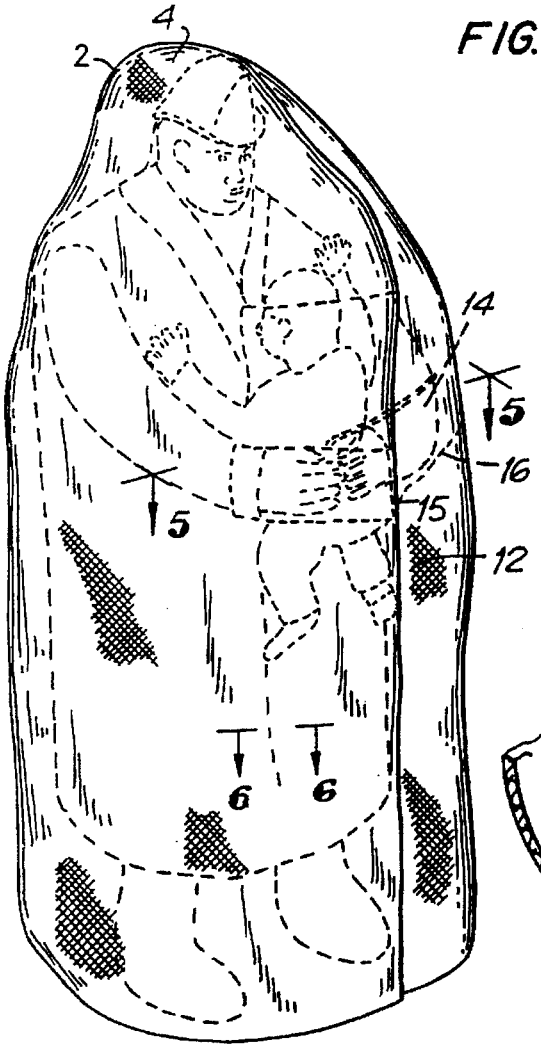
FIG. 4 is a perspective view of the fire protection garment in accordance with the invention demonstrating its use by a rescuer, and a second person, in this case a child.
Figure 5:
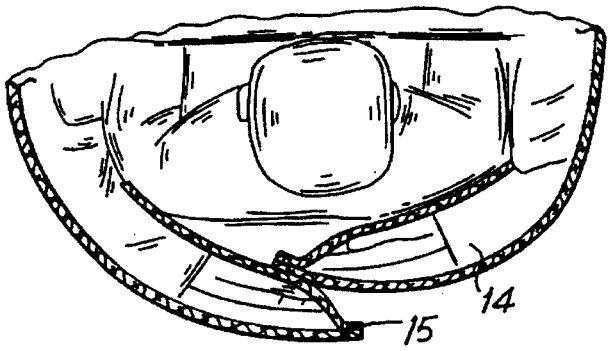
FIG. 5 is a fragmentary cross-sectional view of the fire protection garment of FIG. 4 taken along lines 5—5.

Referring now to the drawings, it will be seen that there is illustrated in FIGS. 1–5 an embodiment of a fire protection garment in accordance with the invention shown generally at 2. The fire protection garment is woven and preferably integrally formed from a single piece of woven fabric 3 to which are sewn two rectangular elongated pieces of fabric 5, 5' defining two internal hand receiving pockets 14. Woven garment 2 has a hood region 4 located at the top of the garment which is used to cover the head of one or more persons as shown in FIG. 4. While FIG. 4 shows one adult and a child, the size of the hood region is such as to accommodate two adults.

Figure 1:
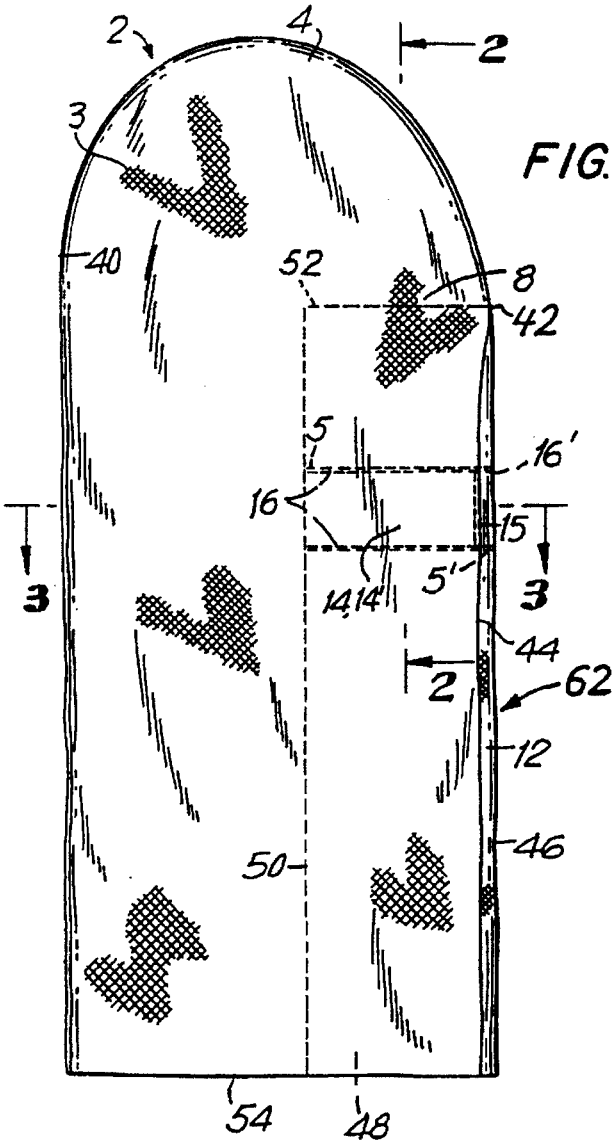
FIG. 1 is a side elevational view of the fire protection garment in accordance with the invention.

Referring to FIGS. 1–3, the single piece of woven fabric 3 is formed from a flat piece of woven material cut and sewn to define the body of the fire protection garment. The shape of hood region 4 is created by a seam 18 joining two cut rounded portions from about point 40 in the back of the garment to a point 42 in the front of the garment, creating a rounded form to integrally fit over the head of one or more persons. Slit 12 is defined between end edge 44 of fabric 3 and a fold line 46. Fold line 46 is formed by a real or imaginary fold between a rectangular panel 48 and the main body of fabric 3. Slit 12 extends from about point 42 to the bottom edge 54 of fabric 3 and defines entrance region 6 (FIG. 2). Panel 48 is defined on one side by the other end edge 50 of fabric 3, on the other side by fold line 46, on the top by top edge 52 and on the bottom by an extension of bottom edge 54 of fabric 3. Top edge 52 of panel 48 is joined to the facing portion of fabric 3 (extending from end edge 44) by a line of stitches 8. Line of stitches 8 and seam 18 essentially meet at about point 42. Slit 12 defines an entrance region 62. This construction permits opening the front of the garment 2 to permit donning the garment and the entry of a second person in front of the first person already in the garment, Panel 48 and stitch line 8 further provides an overlapping region of fabric 3. This overlap construction establishes a more secure closing for entrance region 6 of fire protection garment 2 by insuring that the normal state of the region is closed. Thereby, the rescuers' or victims' faces and bodies can remain covered while walking through fire, but entrance region 6 starting at slit 12 can be readily opened to permit donning of the garment or receiving a second person therein.

Garment 2 includes hand receiving pockets 14, 14' defined by rectangular fabric pieces 5, 5', respectively. Rectangular fabric piece 5 is secured to the inside of fabric 3 extending longitudinally essentially parallel to bottom edge 54 from a point adjacent end edge 44 at about an average arm length relative to the top of hood region 4. Specifically, rectangular fabric piece 5 is secured by side stitch lines 16 extending essentially parallel to bottom edge 54 and by an end stitch line 15 extending essentially parallel to end edge 44, as shown in FIGS. 1–3. Rectangular fabric piece 5' is similarly secured and positioned on the inside of panel 48 extending from end edge 50 in essential registration with rectangular fabric piece 5 by parallel stitch lines 16' and stitch line 15' adjacent said end edge 50.

The hand receiving pockets 14 are specifically designed for the insertion of the rescuer's or user's hand and even a portion of his or her arm. When the hands are inserted, the rescuer or user is able to manipulate the opening of entrance region 6 by moving his arms in the appropriate direction. This is better shown in FIG. 5 which shows the rescuer with his hands in hand receiving pockets 14 controlling slit 12 to be in a closed position. Manipulation of entrance region 6 and slit 12 to open and close same permits opening the slit to let the user see, when fire conditions permit, and to receive a second person. Further, the user's hands within hand receiving pockets 14 can grab objects such as door handles and objects on victims which would otherwise be too hot to handle, without the need for separate protective gloves. If manipulation of the entrance opening to the garment is the only goal, strips of fabric or other materials defining handles can be secured in the position of rectangular fabric pieces 5, 5', in place or in addition thereto, preferably so that the handles extend parallel to the adjacent end edges.

Referring specifically to FIG. 4, there is shown a rescuer and a rescued child within woven garment 2. Hood region 4 covers the rescuer's head. His arms are inserted into hand receiving pockets 14, 14' so that he can open entrance region 6 and slit 12 to pick up the rescued child as shown. In addition, as noted above, the interior of fire protection garment 2 is large enough to protect two adults from being exposed to heat and flames. While a particular configuration for hand receiving pockets is shown, other shapes and orientations are usable so long as the entrance to each of the pockets is inside the garment.

Figure 6:
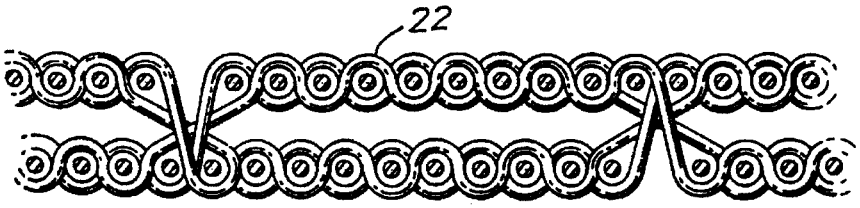
FIG. 6 is a fragmentary cross-section of one embodiment of the fabric of the fire protection garment in accordance with the invention showing a form of the weave formation of the fabric.

Fabric 3 is preferably formed of a material 22 more particularly shown and described in U.S. Pat. No. 3,902,559 issued to Everingham et al and incorporated herein by reference as if fully set forth herein, and as shown in FIG. 6. Everingham discloses a woven fabric of pure wool which is constructed of a high bulk, low density type material so as to be capable of carrying a maximum amount of a fire retardant fluid more particularly described below. Material 22 should preferably be resistant to loss of tensile strength with aging over periods of at least two years. The garment's material should further be formed of a non-flammable (at least when impregnated with water or the above-mentioned solution) and non-heat softening material. The preferred material is a woven fabric having an intercellular weave but the invention is not be limited to such an embodiment. More specifically, the preferred embodiment of material 22 is 100% wool with an intercellular weave capable of absorbing up to 13 times its own weight. However, other materials and fabric structures can be used, so long as the material is capable of absorbing and retaining a fire retarding fluid such as water or the above-mentioned solution. Further, while fabric 3 is shown formed of a single piece of fabric, separate seamed together components can be used. Rectangular fabric pieces 5, 5' are preferably formed of the same material as fabric 3, other materials can be used.

Also, as taught in Everingham, the woven material may be soaked with a viscous aqueous solution of a thickening agent. The thickening agent solution contains a bactericide with the preferred embodiment being tea tree oil or a blend of terpines or terpinols that are generally naturally occurring but can be synthetically prepared. The terpine and terpinol compounds can be obtained either as pure compounds distilled from the natural oils or as a mixture of components derived by distillation or the like from plants of the Melaleuca alternifolia or closely related species, which are more plentiful than the tea tree. Such solutions have the added advantage of providing prompt burn treatment to victims of fire and other burns. However, the fire protection garment in accordance with the invention can be used with other fluids, including water, in order to provide either the fire protection function or the burn treatment function.

Figure 7:
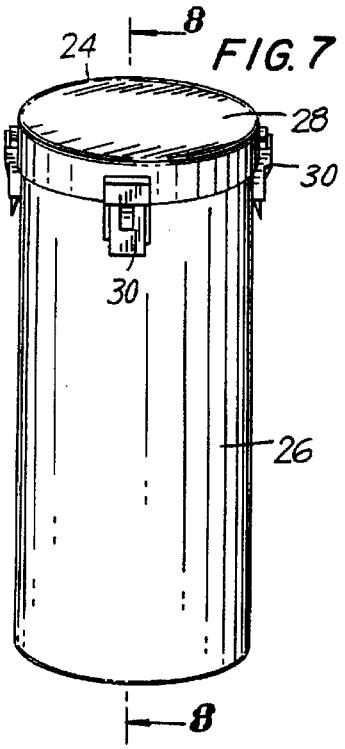
FIG. 7 is a perspective view of a container used for storing the fire protection garment in accordance with the invention.
Figure 8:
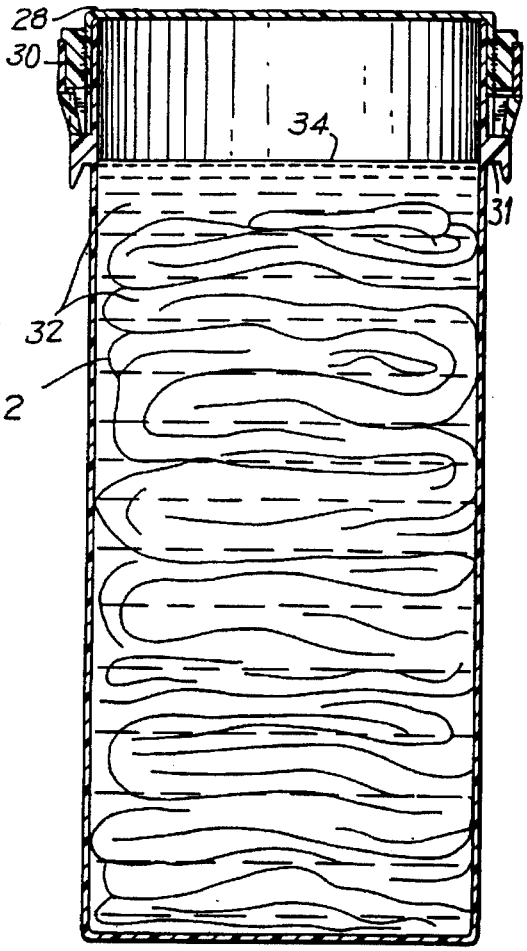
FIG. 8 is a cross-sectional view of the container of FIG. 7 taken along lines 8—8 of FIG. 7.

Referring to FIGS. 7–8, the fire protection garment 2 may be stored in a container 24 designed to retain and protect the garment and fluid so that the garment is available for instant use. Container 24 may be made of a high density polypropylene by injection molding. Container 24 comprises a body part 26 and a lid 28 designed to sealingly close body part 26. Lid 28 is releasably engaged to body part 26 by quick release catches 30 of the type which apply downward pressure on lid 28, which are secured to lid 28 and engage projections 31 on body part 26. Fire protection garment 2 is inserted into the container in any folded manner but preferably one that will allow the quick removal during an emergency situation. Preferably, a zig-zag fold of the type shown in FIG. 8 may be used with hood region 4 on top. Container 24 is then filled with fluid 32 as described above to a level 34 above that of fire protection garment 2 in order to insure complete saturation of the garment. If desired, a resilient gasket (not shown) may extend about the inner top periphery of lid 28 and bear against the top and/or inside wall of body part 26 to protect against contaminants or bacteria entering the container and fluid leaving the container during storage.

Figure 9:
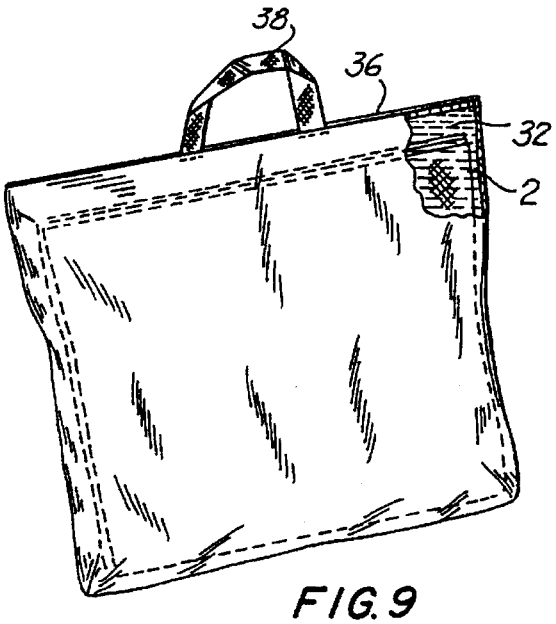
FIG. 9 is a perspective view of an alternative embodiment of a container for storing the fire protection garment.

FIG. 9 discloses a foil pouch 36 which may also be used for the storage of the fire protection garment 2. The pouch is constructed of a combination laminated printed web consisting of a blend of polyester, foil, nylon and polyethylene. A handle 38 is provided. The fire protection garment 2 is inserted into foil pouch 36 and is then saturated with an excess of the desired fluid. Foil pouch 36 is then sealed so that the garment and fluid are protected from bacteria and contaminants. Other containers can be provided and the garment can be provided separately for on site saturation with fluid if desired.

It will thus be seen that the objects set forth above, among those made apparent from the preceding description, are efficiently attained and, since certain changes may be made in the above product without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A method for rescuing a person from a fire emergency comprising:

providing a fire protection garment in a container means, the fire protection garment comprising a hood portion shaped to overlie the head of at least one user;

a body portion depending from the hood portion and formed with an essentially downwardly extending entrance opening in the front thereof and an open bottom, the interior of said fire protection garment being large enough to protect two adult persons from being exposed to heat and flames;

internal hand receiving pockets connected to said body portion, said hand receiving pockets being inaccessible from the exterior of the garment; wherein at least said hood and body portions and said hand receiving pockets are formed of a fabric adapted to retain a fire retarding fluid during use and wherein the container contains a sufficient quantity of said fire retarding fluid to render the fire protection garment resistant to fire;

removing the fire protection garment from the container means;

donning the fire protection garment so as to enclose said user within the fire protection garment;

entering a fire emergency area wherein a person is endangered by the fire emergency;

opening the fire protection garment;

enclosing said person together with said user within the fire protection garment; and escaping from the fire emergency area with said person and said user both enclosed within the fire protection garment.

2. The method according to claim 1 wherein said entering step includes grabbing, with said user's hands in said hand receiving pockets, objects that are too hot to handle without separate protective gloves.

3. The method according to claim 1 wherein said enclosing step includes manipulating said hand receiving pockets so as to enclose said person endangered by the fire emergency within the fire protection garment.

4. The method according to claim 1 wherein an excess of said fluid is provided in said container in relation to that required to saturate the fabric of said fire protection garment.

5. The method according to claim 1 wherein said fluid is selected from a group including water, and an aqueous solution.

6. The method according to claim 1 wherein said fluid is an aqueous solution including a thickening agent to increase the viscosity of the fluid and a bactericide.

7. The method according to claim 6 wherein said bactericide is selected from the group including tea tree oil and a blend of terpines or terpinols.

* * * * *